US011326618B2

(12) United States Patent
Jin

(10) Patent No.: US 11,326,618 B2
(45) Date of Patent: May 10, 2022

(54) CONTINUOUS VARIABLE TRIM COMPRESSOR

(71) Applicants: Hyundai Motor Company, Seoul (KR); Kia Motors Corporation, Seoul (KR)

(72) Inventor: Seok Beom Jin, Gyeonggi-do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 16/996,654

(22) Filed: Aug. 18, 2020

(65) Prior Publication Data

US 2021/0310499 A1 Oct. 7, 2021

(30) Foreign Application Priority Data

Apr. 6, 2020 (KR) ..... 10-2020-0041428

(51) Int. Cl.

| | |
|---|---|
| ***F04D 29/42*** | (2006.01) |
| ***F04D 29/46*** | (2006.01) |
| *F02B 37/12* | (2006.01) |
| *F02B 37/22* | (2006.01) |

(52) U.S. Cl.

CPC ..... *F04D 29/4213* (2013.01); *F04D 29/462* (2013.01); *F02B 37/225* (2013.01); *F02B 2037/125* (2013.01); *F05B 2220/40* (2013.01); *F05D 2270/101* (2013.01)

(58) Field of Classification Search

CPC ..... F04D 15/0038; F04D 27/002; F04D 27/0246; F04D 29/4213; F04D 29/462; F02B 2037/125; F02B 37/225; F05B 2220/40; F05D 2210/42; F05D 2220/40; F05D 2240/12; F05D 2250/90; F05D 2270/101

See application file for complete search history.

(56) References Cited

U.S. PATENT DOCUMENTS

| | | | | |
|---|---|---|---|---|
| 3,407,681 | A * | 10/1968 | Kiernan | F16H 55/12 74/448 |
| 7,571,607 | B2 * | 8/2009 | Vrbas | F02B 37/004 60/605.1 |
| 2007/0231125 | A1 * | 10/2007 | Oeschger | F04D 29/462 415/160 |
| 2015/0125274 | A1 * | 5/2015 | Liang | F04D 29/4213 415/157 |
| 2018/0216632 | A1 * | 8/2018 | Conner | F04D 29/023 |
| 2020/0325792 | A1 * | 10/2020 | Pratt | F04D 29/563 |

FOREIGN PATENT DOCUMENTS

KR 10-2019-0135104 A 12/2019

* cited by examiner

*Primary Examiner* — Eldon T Brockman
*Assistant Examiner* — Danielle M. Christensen
(74) *Attorney, Agent, or Firm* — Mintz Levin Cohn Ferris Glovsky and Popeo, P.C.; Peter F. Corless

(57) ABSTRACT

A continuous variable trim compressor includes: a plurality of rotary vanes provided in a passage of air flowing toward a compressor wheel; and a rotating device configured to rotate the plurality of rotary vanes simultaneously, wherein as the plurality of rotary vanes is rotated simultaneously by the rotating device, a cross-sectional area of the passage of air flowing toward the compressor wheel is variable.

5 Claims, 6 Drawing Sheets

CONTINUOUS VARIABLE TRIM COMPRESSOR

CROSS REFERENCE TO RELATED APPLICATION

The present application claims under 35 U.S.C. § 119(a) the benefit of Korean Patent Application No. 10-2020-0041428, filed Apr. 6, 2020, the entire contents of which are incorporated by reference herein.

BACKGROUND

(a) Technical Field

The present disclosure relates generally to a structure of a compressor used for a turbocharging device of a vehicle.

(b) Description of the Related Art

A turbocharging device such as a turbocharger or a supercharger is used to improve the output of an engine, and the turbocharging device commonly includes a compressor for compressing air.

The compressor should be configured and operated so as not to enter a surge area. However, the compressor of the turbocharging device mounted with an engine of a vehicle is generally configured to have constant fixed sizes and shapes, but operating conditions of the compressor are rapidly changed according to a driving condition of the vehicle such as manipulation of an accelerator pedal by a driver. Therefore, the compressor may be operated while entering the surge area.

The operation of the compressor in the surge area of the compressor acts as a factor that causes unpleasant noise in a vehicle and deteriorates the durability of the compressor.

The foregoing is intended merely to aid in the understanding of the background of the present disclosure, and is not intended to mean that the present disclosure falls within the purview of the related art that is already known to those skilled in the art.

SUMMARY

Accordingly, the present disclosure proposes a continuous variable trim compressor, wherein a compressor constituting a turbocharging device of a vehicle is configured so as not to cause the phenomenon of compressor surge regardless of any sudden change of vehicle operating conditions, thereby preventing unpleasant noise in the vehicle or deterioration in durability of the compressor.

In order to achieve the above objectives, according to one aspect of the present disclosure, there is provided a continuous variable trim compressor. The continuous variable trim compressor includes: a plurality of rotary vanes provided in a passage of air flowing toward a compressor wheel; and a rotating device configured to rotate the plurality of rotary vanes simultaneously, wherein as the plurality of rotary vanes is rotated simultaneously by the rotating device, a cross-sectional area of the passage of air flowing toward the compressor wheel may be varied.

In order to ensure that the plurality of rotary vanes is arranged at a predetermined distance in a circle centered on a rotation shaft of the compressor wheel, each of the rotary vanes may have an axle portion that may be rotatably fixed to a circular fixation ring provided concentrically with the compressor wheel.

Each of the rotary vanes may include a vane portion and an interlocking block, the vane portion having a shape becoming wider as a distance increases from the axle portion, and the interlocking block operated in conjunction with the rotating device being integrally provided on a second side of the axle portion.

The vane portion may include a first edge portion extending in parallel and in a straight line from the axle portion and a second edge portion extending obliquely and in a straight line from the axle portion, wherein the first edge portion may extend with a predetermined constant thickness, and the second edge portion may extend with a thickness that decreases as a distance from the axle portion increases.

The rotating device may include: a vane arm having a first side coupled to the interlocking block of the rotary vane; and a driving ring receiving a second side of the vane arm and rotating the vane arm around the axle portion of the rotary vane.

The second side of the vane arm may have an arcuate end; and the driving ring may have arcuate depressed portions repeatedly arranged along a circumference direction, each of the depressed portions being configured to receive the arcuate end of the vane arm and to maintain a smooth contact state between the vane arm and the driving ring when the driving ring is rotated.

The vane arm may have an insertion hole at the first side and the interlocking block of the rotary vane may be inserted and fixed in the insertion hole so as not to be rotated; and the interlocking block of the rotary vane may have a shape similar to a shape of the insertion hole so as to fit into the insertion hole.

A return spring may be provided between the axle portion of the rotary vane and the fixation ring, the return spring being configured to elastically support the rotary vane in one side of a rotating direction of the rotary vane.

As described above, the present disclosure is configured not to generate the phenomenon of compressor surge in the compressor constituting a turbocharging device of a vehicle even in sudden change of vehicle operating conditions. Accordingly, unpleasant noise in the vehicle or deterioration in the durability of the compressor can be prevented.

BRIEF DESCRIPTION OF THE DRAWINGS

The above and other objectives, features, and other advantages of the present disclosure will be more clearly understood from the following detailed description when taken in conjunction with the accompanying drawings, in which:

FIG. 5 is a side view showing the structure of the continuous variable trim compressor in

FIG. 1;

DETAILED DESCRIPTION OF THE DISCLOSURE

Figure 1:
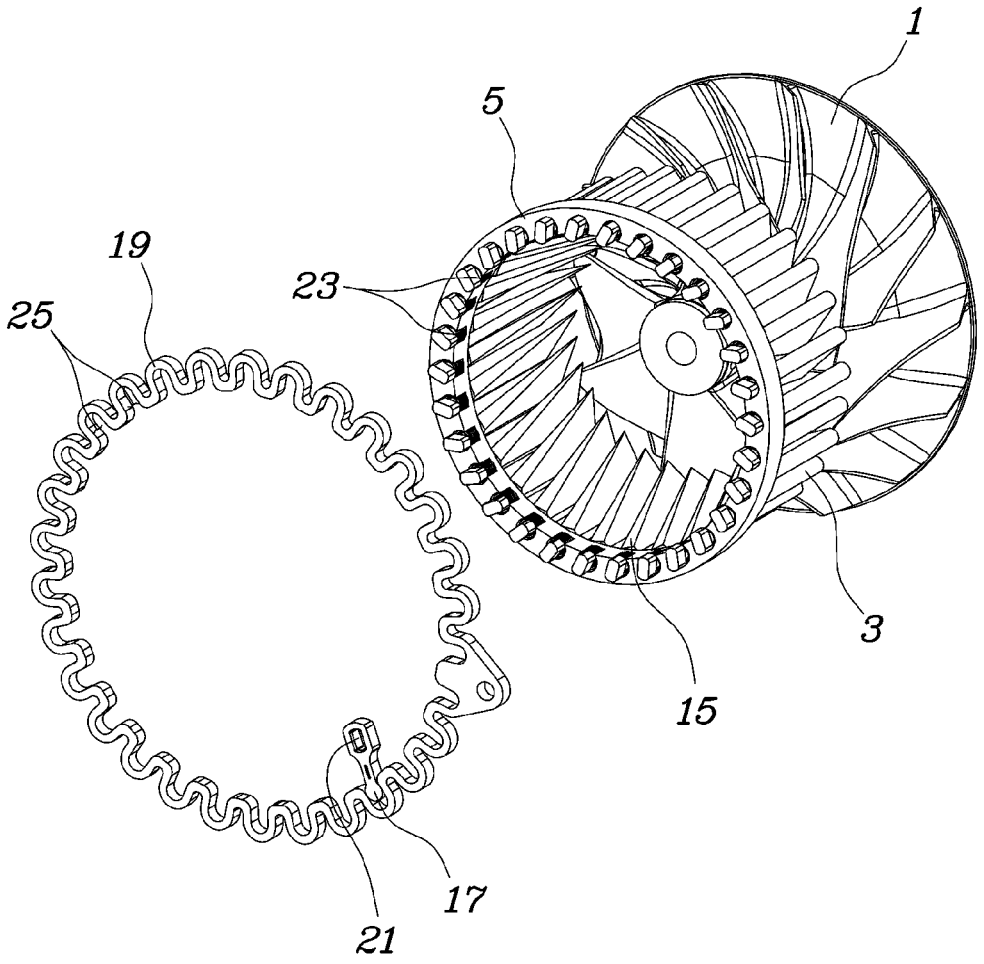
FIG. 1 is a view showing a main structure of a continuous variable trim compressor according to the present disclosure.
Figure 2:
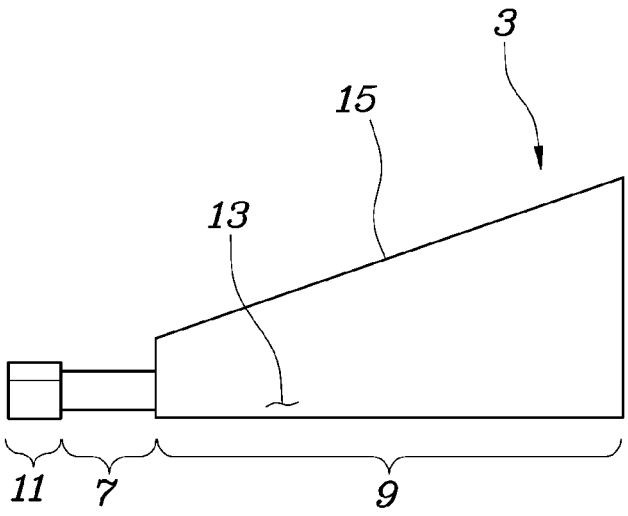
FIG. 2 is a detailed view showing a vane in FIG. 1.
Figure 3:
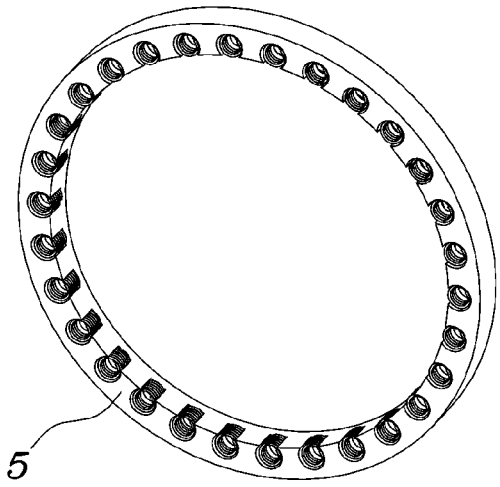
FIG. 3 is a detailed view showing a fixation ring in FIG. 1.
Figure 4:
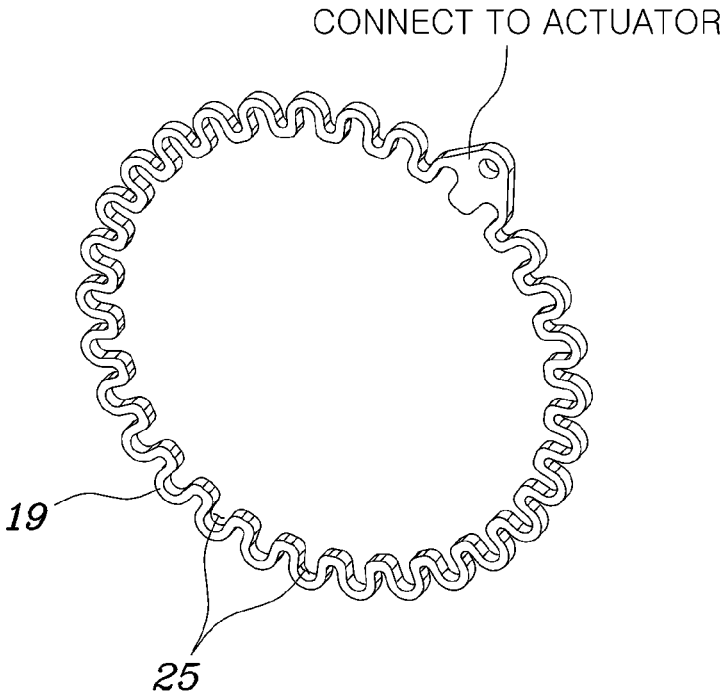
FIG. 4 is a detailed view showing a driving ring in FIG. 1.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the disclosure. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Throughout the specification, unless explicitly described to the contrary, the word "comprise" and variations such as "comprises" or "comprising" will be understood to imply the inclusion of stated elements but not the exclusion of any other elements. In addition, the terms "unit", "-er", "-or", and "module" described in the specification mean units for processing at least one function and operation, and can be implemented by hardware components or software components and combinations thereof.

Further, the control logic of the present disclosure may be embodied as non-transitory computer readable media on a computer readable medium containing executable program instructions executed by a processor, controller or the like. Examples of computer readable media include, but are not limited to, ROM, RAM, compact disc (CD)-ROMs, magnetic tapes, floppy disks, flash drives, smart cards and optical data storage devices. The computer readable medium can also be distributed in network coupled computer systems so that the computer readable media is stored and executed in a distributed fashion, e.g., by a telematics server or a Controller Area Network (CAN).

Referring to FIGS. 1 to 7, according to an embodiment of the present disclosure, a continuous variable trim compressor includes: a plurality of rotary vanes 3 provided in a passage of air flowing toward a compressor wheel 1; and a rotating device provided to rotate the plurality of rotary vanes 3 simultaneously.

That is, as the plurality of rotary vanes 3 is rotated simultaneously by the rotating device, a cross-sectional area of the passage of air flowing toward the compressor wheel 1 is variable. The cross-sectional area of the variable air passage may be continuously varied by the rotating device from a maximum state shown in FIG. 6 to a minimum state shown in FIG. 7.

As described above, when the cross-sectional area of the air passage flowing toward the compressor wheel 1 is varied, there is an effect substantially similar to that when a trim of the compressor is varied, so that flow of air compressed through the compressor wheel 1 may be to varied.

When the flow of air flowing through the compressor wheel 1 is varied, even in a state where a surge may normally occur, a surge may be prevented from occurring substantially.

Figure 6:
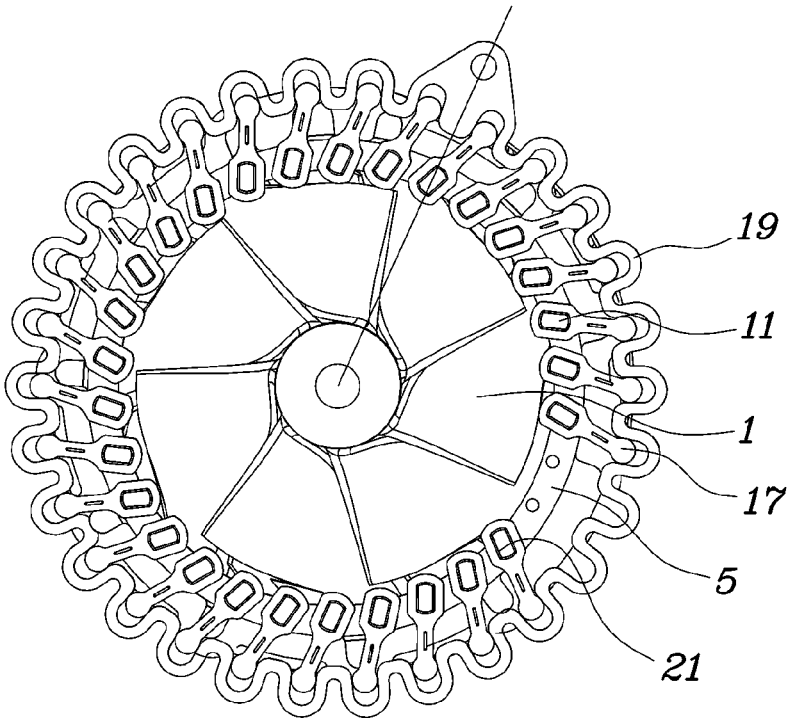
FIG. 6 is a view showing the continuous variable trim compressor of the present disclosure in a normal operation state taken in a direction of a rotation shaft of a compressor wheel.
Figure 7:
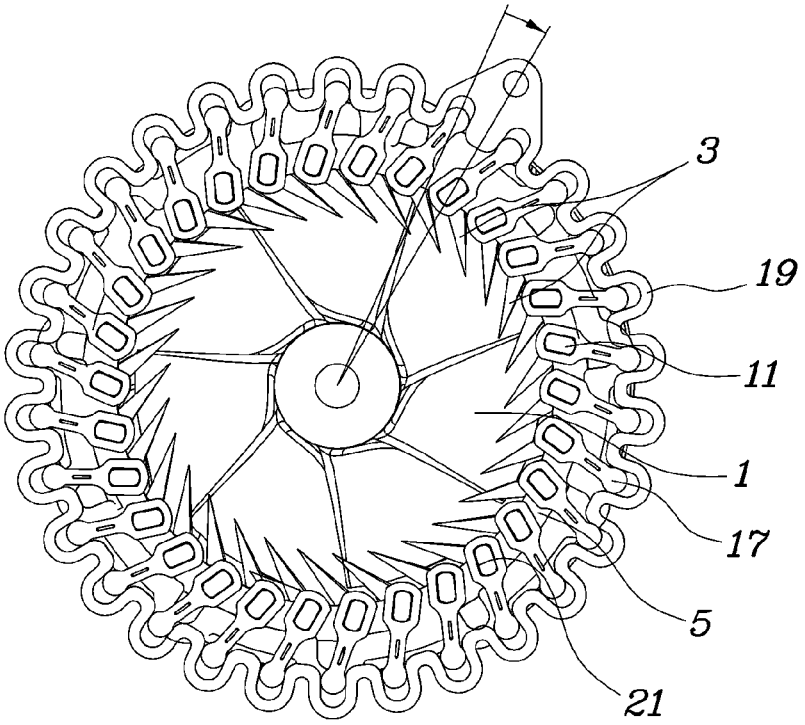
FIG. 7 is a view showing the continuous variable trim compressor of the present disclosure in a serge operation state taken in the direction of the rotation shaft of the compressor wheel.

For example, the state in FIG. 6 is a normal operation state in which surge is prevented from occurring, and the cross-sectional area of the passage is configured to reduce resistance of air flowing into the compressor wheel 1. FIG. 7 shows the state, in which when a surge occurs, the cross-sectional area of the air passage flowing toward the compressor wheel 1 is reduced to vary the flow of air passing through the compressor wheel 1, so that occurrence of the surge may be inhibited.

The trim is an index that relates to a size of the compressor wheel 1, and is determined by the following equation in the ratio of a maximum diameter d2 and a minimum diameter d1.

$$TRIM = \left(\frac{d1}{d2}\right)^2 \times 100$$

Figure 5:
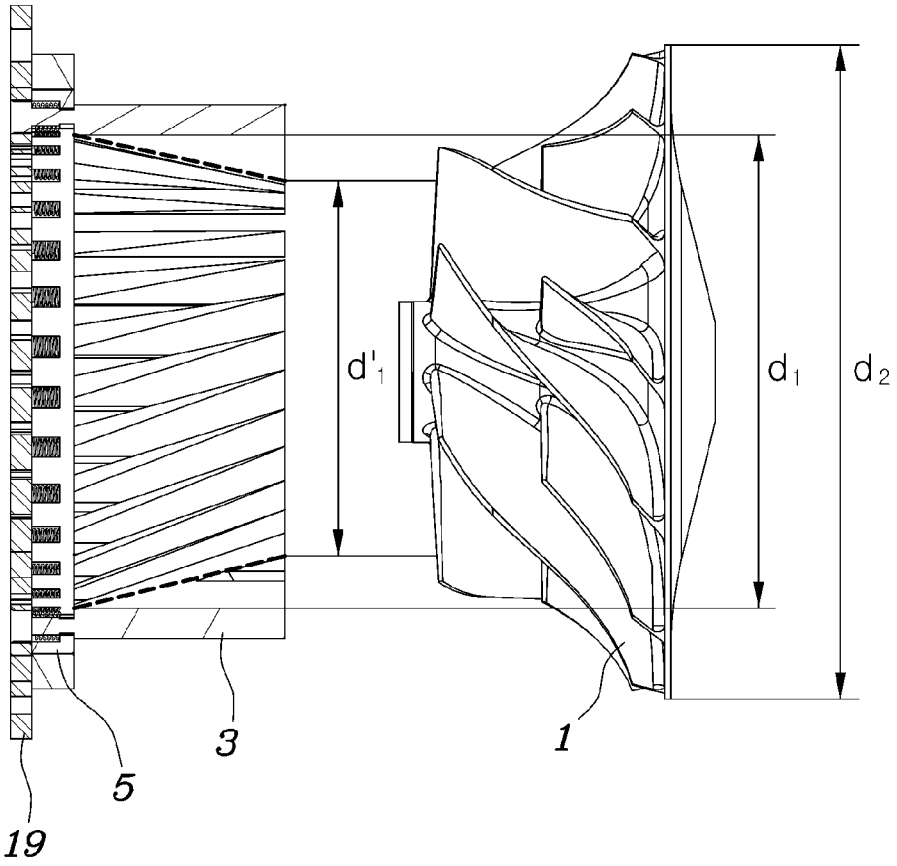

As shown in FIG. 5, as the rotating device rotates the plurality of rotary vanes 3 as described above, the minimum diameter of the compressor wheel 1 may be varied from d1 to d1'.

Considering the above equation, in the present disclosure, the maximum diameter of the compressor wheel 1 is maintained constant but the minimum diameter is continuously varied from d1 to d1' by the rotating device, so that the trim may be continuously varied.

When the trim of the compressor is varied as described above, the flow of air passing through the compressor wheel 1 is varied substantially, so that surge may be prevented from occurring even in the state where surge may occur.

That is, when surge occurs in the state in FIG. 6, the plurality of rotary vanes 3 is rotated to be in the state of FIG. 7, and the flow separation of air is reduced at a leading edge, which is an end of the blade providing the minimum diameter of the compressor wheel 1, of a blade while air flowing into the compressor wheel 1 is guided toward the center of the compressor wheel 1. As a result, a surge effect may be inhibited.

In order to arrange the plurality of rotary vanes 3 at a predetermined distance in a circle centered around a rotation shaft of the compressor wheel 1, each of the rotary vanes 3 has an axle portion 7 that is rotatably fixed to a circular fixation ring 5 provided concentrically with the compressor wheel 1.

The fixation ring 5 rotatably supports the compressor wheel 1, forms the passage of air flowing into the compressor wheel 1, and is fixed to a compressor housing provided to discharge air compressed through the compressor wheel 1.

That is, as each of the rotary vanes 3 is fixed to the fixation ring 5 by using the axle portion 7 as a rotation shaft, the rotary vane 3 may be rotatably fixed to the compressor housing.

The rotary vane 3 has a structure including a vane portion 9 and an interlocking block 11. The vane portion 9 has a shape that becomes wider as a distance increases from the axle portion 7 on a first side of the axle portion 7, and the interlocking block 11 operated in conjunction with the rotating device is integrally provided on a second side of the axle portion 7.

The vane portion 9 includes a first edge portion 13 extending in parallel and in a straight line from the axle portion 7, and a second edge portion 15 extending obliquely and in a straight line from the axle portion 7. The first edge portion 13 extends with a predetermined constant thickness and the second edge portion 15 extends with a thickness that decreases as a distance from the axle portion 7 increases.

As the second edge portion 15 is formed to have the thickness that decreases as the distance from the axle portion 7 increases, when the rotary vanes 3 overlap each other as much as possible as shown in FIG. 6 and the air passage flowing toward the compressor wheel 1 is maximized, interference between the rotary vanes 3 is minimized, so that the cross-sectional area of the air passage may be adequately provided.

In the embodiment, the rotating device includes a vane arm 17 and a driving ring 19. The vane arm 17 has a first side coupled to the interlocking block 11 of the rotary vane 3, and the driving ring 19 receives second side of the vane arm 17 and rotates the vane arm 17 around the axle portion 7 of the rotary vane 3.

The second side of the vane arm 17 has an arcuate end. The driving ring 19 has arcuate depressed portions 25 repeatedly arranged along a circumference direction, each of the depressed portions being configured to receive the arcuate end of the vane arm 17 and to maintain a smooth contact state between the vane arm 17 and the driving ring 19 when the driving ring 19 is rotated.

The driving ring 19 is coupled to an external actuator to receive a rotational force.

For reference, the vane arm 17 is configured to be individually installed on all of the rotary vanes 3 as described above, but as provided herein, some vane arms 17 may be omitted in order to illustrate the structure of the present disclosure simply and clearly.

The vane arm 17 has an insertion hole 21 at the first side so that the interlocking block 11 of the rotary vane 3 is inserted and fixed in the insertion hole 21 so as not to be rotated. The interlocking block 11 of the rotary vane 3 has a shape similar to a shape of the insertion hole 21 so as to fit into the insertion hole 21.

Accordingly, as the vane arm 17 is assembled to the interlocking block 11 of the rotary vane 3, the present disclosure may provide a structure in which a rotational force applied by the vane arm 17 may be stably transmitted to the rotary vane 3.

A return spring 23 may be provided between the axle portion 7 of the rotary vane 3 and the fixation ring 5 and the return spring 23 may be configured to elastically support the rotary vane 3 in one side of a rotating direction.

Accordingly, when the rotational force is not applied from the outside to the driving ring 19, the plurality of rotary vanes 3 is maintained in the state shown in FIG. 6 by the return spring 23. When the driving ring 19 is rotated, the plurality of rotary vanes 3 may overcome an elastic force of the return spring 23 and be rotated to be gradually varied to the state shown in FIG. 7. When the force acting on the driving ring 19 is released, the plurality of rotary vanes 3 may be returned to the state in FIG. 6 by a force of the return spring 23.

Without the return spring 23, it is possible that the return operation of the plurality of rotary vanes 3 is implemented by the actuator connected to the driving ring 19.

Although preferred embodiment of the present disclosure has been described for illustrative purposes, those skilled in the art will appreciate that various modifications, additions and substitutions are possible, without departing from the scope and spirit of the present disclosure as disclosed in the accompanying claims.

What is claimed is:

1. A continuous variable trim compressor, comprising:

a plurality of rotary vanes provided in a passage of air flowing toward a compressor wheel; and a rotating device configured to rotate the plurality of rotary vanes simultaneously, wherein as the plurality of rotary vanes is rotated simultaneously by the rotating device, a cross-sectional area of the passage of air flowing toward the compressor wheel is variable, wherein in order to ensure that the plurality of rotary vanes is arranged at a predetermined distance in a circle centered around a rotation shaft of the compressor wheel, each of the rotary vanes has an axle portion that is rotatably fixed to a circular fixation ring provided concentrically with the compressor wheel, wherein each of the rotary vanes comprises a vane portion and an interlocking block, the vane portion having a shape becoming wider as a distance increases from the axle portion on a first side of the axle portion, and the interlocking block operated in conjunction with the rotating device being integrally provided on a second side of the axle portion, and wherein the vane portion comprises a first edge portion extending in parallel and in a straight line from the axle portion, and a second edge portion extending obliquely and in a straight line from the axle portion, wherein the first edge portion extends with a predetermined constant thickness, and the second edge portion extends with a thickness that decreases as a distance from the axle portion increases.

2. The continuous variable trim compressor of claim 1, wherein the rotating device comprises:

a vane arm having a first side coupled to the interlocking block of the rotary vane; and a driving ring receiving a second side of the vane arm and configured to rotate the vane arm around the axle portion of the rotary vane.

3. The continuous variable trim compressor of claim 2, wherein the second side of the vane arm has an arcuate end; and the driving ring has arcuate depressed portions repeatedly arranged along a circumference direction, each of the depressed portions being configured to receive the arcuate end of the vane arm and to maintain a smooth contact state between the vane arm and the driving ring when the driving ring is rotated.

4. The continuous variable trim compressor of claim 2, wherein the vane arm has an insertion hole at the first side, and the interlocking block of the rotary vane is inserted and fixed in the insertion hole so as not to be rotated; and the interlocking block of the rotary vane has a shape similar to a shape of the insertion hole so as to fit into the insertion hole.

5. The continuous variable trim compressor of claim 1, wherein a return spring is provided between the axle portion of the rotary vane and the fixation ring, the return spring being configured to elastically support the rotary vane in one side of a rotating direction of the rotary vane.

* * * * *